US006866364B2

(12) United States Patent
Torgerson et al.

(10) Patent No.: US 6,866,364 B2
(45) Date of Patent: Mar. 15, 2005

(54) PRINTHEAD HAVING DROP GENERATORS IN STAGGERED AXIS GROUPS

(75) Inventors: Joseph M. Torgerson, Philomath, OR (US); Angela W. Bakkom, Corvallis, OR (US); Mark H. MacKenzie, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/424,240

(22) Filed: Apr. 25, 2003

(65) Prior Publication Data

US 2003/0184614 A1 Oct. 2, 2003

Related U.S. Application Data

(63) Continuation of application No. 09/640,283, filed on Aug. 16, 2000, now Pat. No. 6,585,352.

(51) Int. Cl.[7] ..... B41J 2/15

(52) U.S. Cl. ..... 347/40; 347/12; 347/43

(58) Field of Search ..... 347/40, 12, 43, 347/66, 84, 85, 86, 58, 59, 15, 50, 65, 68

(56) References Cited

U.S. PATENT DOCUMENTS 6,585,352 B1 * 7/2003 Torgerson et al. ..... 347/40

* cited by examiner

*Primary Examiner*—Lamson Nguyen

(57) ABSTRACT

A fluid ejection device includes a substrate having fluid feed slots coupled to a fluid supply, and a plurality of drop generators fluidically coupled to the fluid feed slots and formed in the substrate. The plurality of drop generators are arranged in at least three staggered axis groups along axes that are approximately parallel and spaced transverse to each other substrate.

20 Claims, 13 Drawing Sheets

PRINTHEAD HAVING DROP GENERATORS IN STAGGERED AXIS GROUPS

CROSS REFERENCE TO RELATED APPLICATION(S)

This is a continuation of application Ser. No. 09/640,283 filed on Aug. 16, 2000 now U.S. Pat. No. 6,585,352, which is hereby incorporated by reference herein.

BACKGROUND OF THE INVENTION

1. Field of the Invention

The present invention relates in general to thermal ink jet (TIJ) printheads and more specifically to a system and method for high-performance printing that uses a compact monochrome printhead having staggered, high-density arrangement of ink drop generators.

2. Related Art

Thermal ink jet (TIJ) printers are popular and widely used in the computer field. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Ink jet printers produce high-quality print, are compact and portable, and print quickly and quietly because only ink strikes a print medium (such as paper).

An ink jet printer produces a printed image by printing a pattern of individual dots (or pixels) at specific defined locations of an array. These dot locations, which are conveniently visualized as being small dots in a rectilinear array, are defined by the pattern being printed. The printing operation, therefore, can be pictured as the filling of a pattern of dot locations with dots of ink.

Ink jet printers print dots by ejecting a small volume of ink onto the print medium. An ink supply device, such as an ink reservoir, supplies ink to the ink drop generators. The ink drop generators are controlled by a microprocessor or other controller and eject ink drops at appropriate times upon command by the microprocessor. The timing of ink drop ejections generally corresponds to the pixel pattern of the image being printed.

In general, the ink drop generators eject ink drops through an orifice (such as a nozzle) by rapidly heating a small volume of ink located within a vaporization or firing chamber. The vaporization of the ink drops typically is accomplished using an electric heater, such as a small thin-film (or firing) resistor. Ejection of an ink drop is achieved by passing an electric current through a selected firing resistor to superheat a thin layer of ink located within a selected firing chamber. This superheating causes an explosive vaporization of the thin layer of ink and an ink drop ejection through an associated nozzle of the printhead.

Ink drop ejections are positioned on the print medium by a moving carriage assembly that supports a printhead assembly containing the ink drop generators. The carriage assembly traverses over the print medium surface and positions the printhead assembly depending on the pattern being printed. The carriage assembly imparts relative motion between the printhead assembly and the print medium along a "scan axis". In general, the scan axis is in a direction parallel to the width of the print medium and a single "scan" of the carriage assembly means that the carriage assembly displaces the printhead assembly once across approximately the width of the print medium. Between scans, the print medium is typically advanced relative to the printhead along a "media (or paper) advance axis" that is perpendicular to the scan axis (and generally along the length of the print medium).

As the printhead assembly is moved along the scan axis a swath of intermittent lines is generated. The superposition of these intermittent lines creates the appearance as text or image of a printed image. Print resolution along the media advance axis is often referred to as a density of these intermittent lines along the media advance axis. Thus, the higher the density of the intermittent lines in the media advance axis the greater the print resolution along that axis.

The density of the intermittent lines along the media advance axis (and thus the print resolution) can be increased by increasing the number of ink drop generators on the printhead. This results in better print resolution and increased print speed. Moreover, due to several factors, it is desirable to increase the number of ink drop generators without increasing the size of the printhead. However, merely increasing the number of drop generators on an existing printhead greatly increases the amount of heat dissipated in the printhead during print operations. This increased heat dissipation can cause unwanted printhead thermal excursions. These large thermal excursions on the printhead adversely affect printhead operation and can cause print quality defects, printhead thermal shutdown and even failure of the entire printhead.

One technique that may be used to avoid large thermal excursions is to slow down the speed of the printhead. This technique, however, negates the positive effect of providing more ink drop generators on the printhead. Another technique that may be used to avoid a large thermal excursion is to increase the size of the printhead. A primary disadvantage of this technique, however, is that increasing printhead size increases the cost of the printing system. This is unacceptable because printing systems are rapidly decreasing in price and a printing system having the added cost of a larger printhead will not be competitive in the marketplace. What is needed, therefore, is a way of providing a compact, high nozzle count, and high performance printhead that does not suffer from deleterious thermal excursions.

SUMMARY OF THE INVENTION

To overcome the limitations in the prior art as described above, and to overcome other limitations that will become apparent upon reading and understanding the present specification, the present invention is embodied in a compact monochrome ink jet printhead having a high-density of ink drop generators. The present invention provides a high-performance design that enable high-resolution and high-speed printing while reducing cost due to an efficient use of printhead space. In particular, the compact, high-performance printhead of the present invention includes several performance improving aspects that allow a large number of ink drop generators to be placed on a compact printhead while minimizing problems such as thermal excursions.

The compact, monochrome ink jet printhead of the present invention enables high-performance printing that includes high-resolution and high-speed printing. In particular, one technique used to increase print resolution and speed is to increase the number of ink drop generators, stagger them with respect to groups of other ink drop generators and operate the ink drop generators at a high frequency. This staggered, high-density arrangement helps increase an effective resolution of the printhead. The present invention includes a high-density staggered arrangement of ink drop generators disposed on a compact printhead substrate. Each ink drop generator is a thin-film structure formed in printhead substrate that is fluidically coupled to an ink supply device and includes a nozzle. Ink is supplied to the ink drop generators and at the appropriate time heated and ejected from the associated nozzle.

In a preferred embodiment, the ink drop generator density on the compact printhead exceeds 10 ink drop generators per square millimeter and the compact printhead contains at least 350 nozzles. The ink drop generators (and corresponding nozzles) are arranged in at least three parallel rows. Each row is staggered (or offset) relative to an adjacent row to provide a greater effective pitch that a non-staggered arrangement.

The present invention also reduces costs associated with a printhead having a high-density of ink drop generators by placing the generators on a compact printhead. In order to facilitate a high density of ink drop generators on a compact substrate the present invention includes several techniques to improve thermal efficiency. One technique for improving thermal efficiency is providing thermally-efficient ink drop generators having a thin-film structure that includes high-resistance resistors and a thin passivation layer.

The high-density arrangement of ink drop generators on a compact printhead provides high-performance printing in a portable and low-cost package. Specifically, by using thermally-efficient ink drop generators and providing exceptional thermal control of the compact printhead, the present invention can provide high-speed, high-resolution and high-quality printing. The present invention also includes a method of high-performance printing using the compact ink jet printhead of the present invention.

Other aspects and advantages of the present invention as well as a more complete understanding thereof will become apparent from the following detailed description, taken in conjunction with the accompanying drawings, illustrating by way of example the principles of the invention. Moreover, it is intended that the scope of the invention be limited by the claims and not by the preceding summary or the following detailed description.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the present invention.

Referring now to the drawings in which like reference numbers represent corresponding parts throughout.

DETAILED DESCRIPTION OF THE PREFERRED EMBODIMENTS

Figure 1:
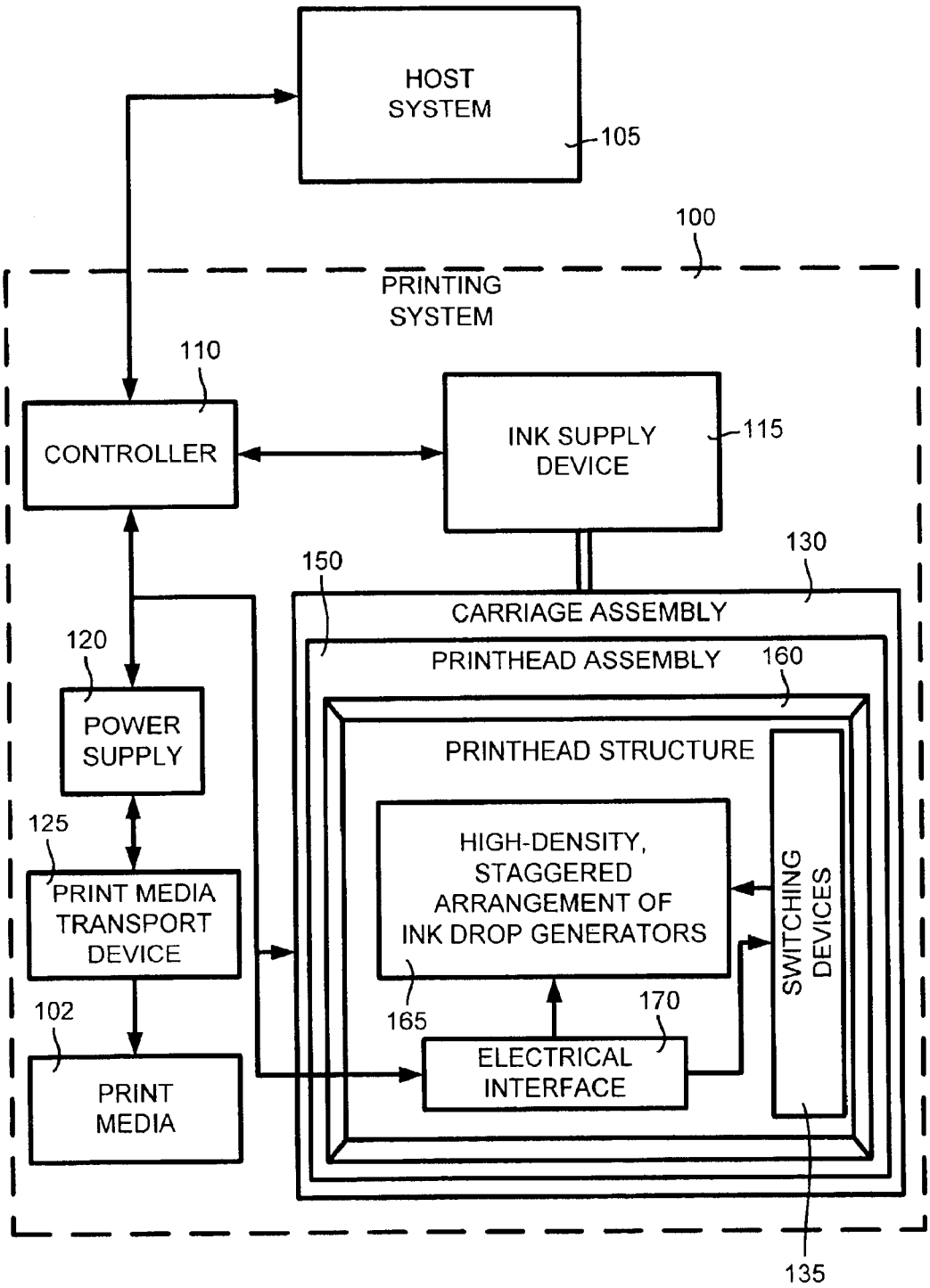
FIG. 1 is a block diagram of an overall printing system incorporating the present invention.

In the following description of the invention, reference is made to the accompanying drawings, which form a part thereof, and in which is shown by way of illustration a specific example whereby the invention may be practiced. It is to be understood that other embodiments may be utilized and structural changes may be made without departing from the scope of the present invention.

I. General Overview

The present invention is embodied in a compact monochrome printhead having a high-density arrangement of staggered ink drop generators. This arrangement provides the present invention with high-resolution and high-speed printing. In order to achieve optimum printing system performance, a number of aspects of the present invention are important.

One aspect of the present invention concerns the use of a high-resolution printhead having a high nozzle count that operates at high frequency. Resolution of a printhead (as opposed to a printed document) is measured according to a number of nozzles per linear inch. This is measured in a direction that is aligned with the media advance axis, and, in the case of scanning printheads, transverse to the scan axis. In an exemplary embodiment, the printhead of the present invention has a nozzle array size of one-third of an inch and a combined resolution of 1200 dots per inch (dpi) measured along the media advance axis. In addition, the operating frequency of the printhead in this exemplary embodiment is at least 12 kilohertz (kHz).

The printhead of the present invention uses a staggered arrangement of ink drop generators to increase print quality, speed and resolution. In particular, a plurality of ink drop generators are disposed along multiple axes and are positioned to scan across the same portion of print media in the media advance axis direction. Each plurality of ink drop generators along an axis (or axis groups) have centerlines and the centerlines of all axis groups are parallel to the media advance axis and are spaced apart from each other in a direction transverse to the media advance axis. The nozzles of each axis group are staggered relative to other axis groups such that at least three axis groups have a combined resolution (measured along the media advance axis) of greater than double the resolution of a single axis group. Staggering provides higher resolution printing in fewer passes and provides high print speed at high resolution by increasing the effective nozzle density in the media advance axis. Further details of the printhead of the present invention are discussed in co-pending patent application Hewlett-Packard Docket No. 10992318-1 serial number 10/424,240 entitled "High-Performance, High-Density Ink Jet Printhead Having Multi-Mode Operation" by Joe Torgerson et al. and filed on the same date of the present application.

In an exemplary embodiment, the printhead contains four axis groups having centerlines that are mutually parallel and are spaced apart from each other in a direction transverse to the centerlines. Each axis group has an axis pitch (or resolution) of approximately 300 dpi. The staggered arrangement provided by the present invention provides an effective pitch of all four combined axis groups of 1200 dpi (measured along the media axis). Preferably, the ends of the four axis groups are aligned to within $1/300^{th}$ of an inch so that the effective pitch of the combination of all four axis groups will be 1200 dpi from end to end for the swath covered during a print scan.

Another aspect of the present invention includes using a space efficient layout of the large number of nozzles to minimize the size of the printhead, and enable the use of the printhead in a relative low cost printing system. This space efficient layout includes a high aspect ratio substrate having two central ink feed slots that have a very compact arrangement and primitives of ink drop generators having common ground leads. Still another aspect of the present invention includes an energy efficient design for the ink drop generators. By using relatively high resistance resistors that have relatively low thermal impedance protection layers, the amount of thermal energy transferred to the substrate per drop generated is minimized.

II. Structural Overview

FIG. 1 is a block diagram of an overall printing system incorporating the present invention. The printing system 100 can be used for printing on a media, such as ink on a print media 102 (which can be paper). The printing system 100 is coupled to a host system 105 (such as a computer or microprocessor) for producing print data. The printing system 100 includes a controller 110, a power supply 120, a print media transport device 125, a carriage assembly 130 and a plurality of switching devices 135. An ink supply device 115 is fluidically coupled to a printhead assembly 150 for selectively providing ink to the printhead assembly 150. The print media transport device 125 provides a means to move a print media 102 (such as paper) relative to the printing system 100. Similarly, the carriage assembly 130 supports the printhead assembly 150 and provides a means to move the printhead assembly 150 to a specific location over the print media 102 as instructed by the controller 110.

The printhead assembly 150 includes a compact printhead structure 160. As described in detail below, the printhead structure 160 of the present invention contains a plurality of various layers including a substrate (not shown). The printhead substrate may be a single monolithic substrate that is made of any suitable material (preferably having a low coefficient of thermal expansion), such as, for example, silicon. The printhead structure 160 also includes a high-density, staggered arrangement of ink drop generators 165 formed in the printhead substrate. The arrangement of ink drop generators 165 includes a thermally-efficient design that permits a large number of ink drop generators to be disposed on a relatively compact printhead substrate without large thermal excursions. In addition, each one of the arrangement of ink drop generators 165 includes a plurality of elements for causing an ink drop to be ejected from the printhead assembly 150. The compact printhead structure 160 also includes an electrical interface 170 that provides energy to the switching devices 135 that in turn provide power to the high-density, staggered arrangement of ink drop generators 165.

During operation of the printing system 100 the power supply 120 provides a controlled voltage to the controller 110, the print media transport device 125, the carriage assembly 130 and the printhead assembly 150. In addition, the controller 110 receives the print data from the host system 105 and processes the data into printer control information and image data. The processed data, image data and other static and dynamically generated data are provided to the print media transport device 125, the carriage assembly 130 and the printhead assembly 150 for efficiently controlling the printing system 100.

Exemplary Printing System

Figure 2:
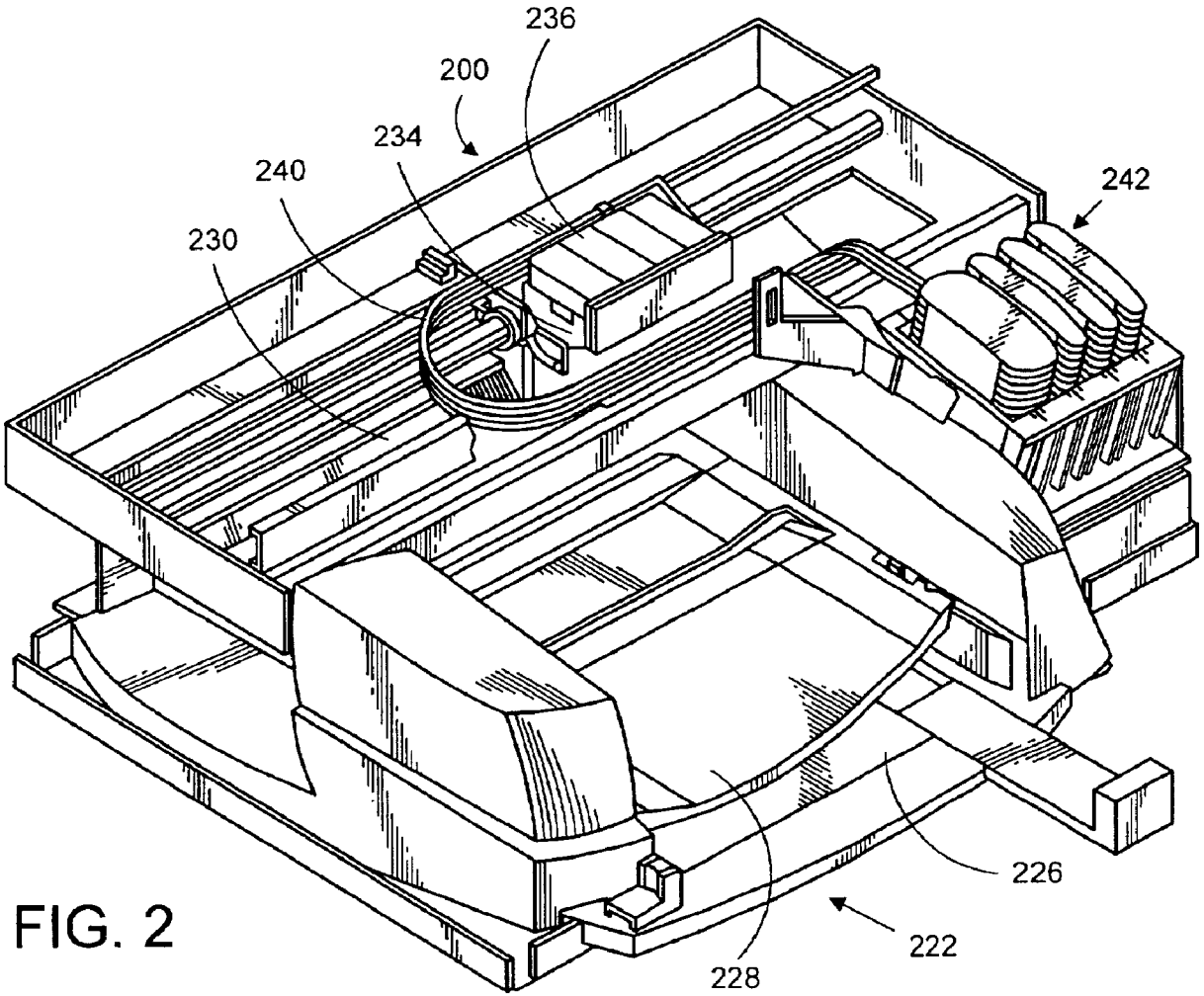
FIG. 2 is an exemplary printing system that incorporates the compact high-performance, high-density ink jet printhead of the present invention and is shown for illustrative purposes only.

FIG. 2 is an exemplary printing system that incorporates the high-performance, high-density ink jet printhead of the present invention and is shown for illustrative purposes only. As shown in FIG. 2, the printing system 200 includes a tray 222 for holding print media. When a printing operation is initiated, the print media is transported into the printing system 200 from the tray 222 preferably using a sheet feeder 226 in a direction of a media advance axis 227. The print media is then transported in a U-direction within the printing system 200 and exits in the opposite direction of entry toward an output tray 228. Other print media paths, such as a straight paper path, may also be used.

Upon entrance into the printing system 200 the print media is paused within a print zone 230 and the carriage assembly 130, which supports at least one printhead assembly 150 of the present invention, is then moved (or scanned) across the print media in a scan axis 234 direction for printing a swath of ink drops thereon. The printhead assembly 150 can be removeably mounted or permanently mounted to the carriage assembly 130. In addition, the printhead assembly 150 is coupled to the ink supply device 115. The ink supply device 115 may be a self-contained ink supply device (such as a self-contained ink reservoir). Alternatively, the printhead assembly 150 may be fluidically coupled, via a flexible conduit, to the ink supply device 115. As a further alternative, the ink supply device 115 may be one or more ink containers separate or separable from the printhead assembly 150 and removeably mounted to the carriage assembly 130.

Figure 3:
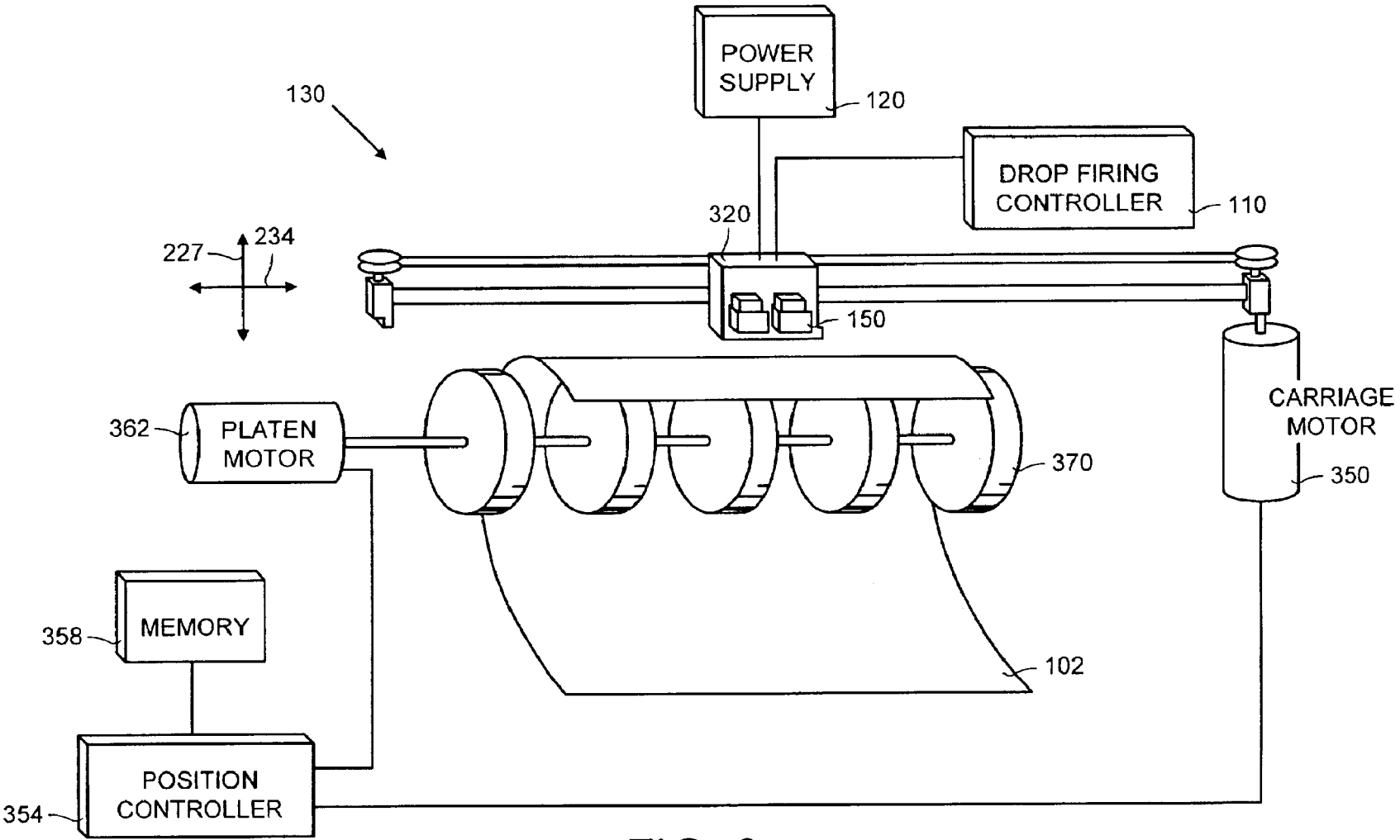
FIG. 3 illustrates an exemplary carriage assembly of the printing system of FIG. 2 that supports the compact high-performance, high-density ink jet printhead of the present invention.

FIG. 3 illustrates an exemplary carriage assembly of the printing system of FIG. 2 that supports the high-performance, high-density ink jet printhead of the present invention. The carriage assembly 130 includes a scanning carriage 320 that supports the printhead assembly 150, which may be removable or permanently mounted to the scanning carriage 320. The controller 110, is coupled to the scanning carriage 320 and provides control information to the printhead assembly 150.

The scanning carriage 320 is moveable along a straight path direction in the scan axis 234. A carriage motor 350, such as stepper motor, transports the scanning carriage 320 along the scan axis 234 according to commands from a position controller 354 (which is in communication with the controller 110). The position controller 354 is provided with memory 358 to enable the position controller 354 to know its position along the scan axis 234. The position controller 354 is coupled to a platen motor 362 (such as a stepper motor) that transports the print media 102 incrementally. The print media 102 is moved by a pressure applied between the print media 102 and a platen 370. Electrical power to run the electrical components of the printing system 200 (such as the carriage motor 350 and the platen motor 362) as well as energy to cause the printhead assembly 150 to eject ink drops is provided by the power supply 120.

In general, a print operation occurs by feeding the print media 102 from the tray 222 and transporting the print media 102 into the print zone 230 by rotating the platen motor 362 and thus the platen 370 in the media advance axis 227. When the print media 102 is positioned correctly in the print zone 230, the carriage motor 350 positions (or scans) the scanning carriage 320 and printhead assembly 150 over the print media 102 in the scan axis 234 for printing. After a single scan or multiple scans, the print media 102 is then incrementally shifted by the platen motor 362 in the media advance axis 227 thereby positioning another area of the print media 102 in the print zone 230. The scanning carriage 320 again scans across the print media 102 to print another swath of ink drops. The process is repeated until the desired print data has been printed on the print media 102 at which point the print media 102 is ejected into the output tray 228.

III. Printhead Architecture

The compact printhead of the present invention includes a high-density staggered arrangement of ink drop generators that provides high-resolution printing at high speed. The high-density arrangement of ink drop generators has a thermally efficient design to permit a high-density of ink drop generators to be disposed on a compact printhead substrate. In a preferred embodiment, the compact printhead substrate has an ink drop generator density exceeding approximately ten ink drop generators per square millimeter. Moreover, in a preferred embodiment the ink drop generators are arranged in groups along at least four axes (each known as an axis group) with each axis group having a plurality of nozzles. The plurality of nozzles for each axis group is approximately one-third of an inch in length resulting in approximately twelve nozzles per square millimeter. The thermally-efficient ink drop generator of the present invention is a thin-film structure that includes a thermally-efficient resistor structure having a high resistance and a thin passivation.

Another aspect of the present invention is having a reduced number of input leads to the printhead relative to the number of ink drop generators located on the compact printhead substrate. In particular, ink drop generators are arranged in groups called primitives, and in the present invention the number of ground connections from the printer is less than the number of primitives. In a preferred embodiment, there are four ground connections for sixteen primitives. Moreover, another aspect is having ink drops being ejected with a low drop weight at a high ejection frequency. For example, in a preferred embodiment the ink drops have an ink drop weight of about 15 nanograms and are ejected at an ejection frequency of greater than 12 kilohertz (kHz).

Figure 4:
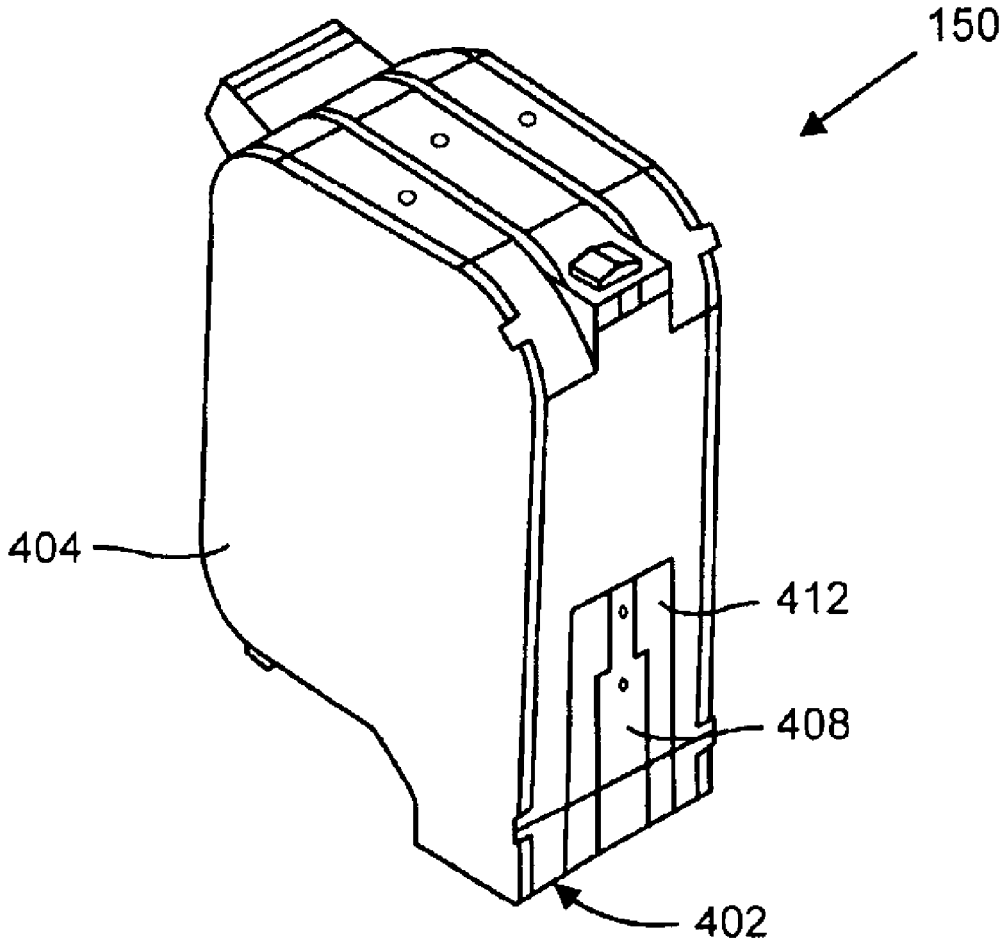
FIG. 4 is a perspective view of the printhead assembly of the present invention and is shown for illustrative purposes only.

FIG. 4 is a perspective view of the printhead assembly of the present invention and is shown for illustrative purposes only. A detailed description of the present invention follows with reference to a typical printhead assembly used with a typical printing system, such as printer 200 of FIG. 2. However, the present invention can be incorporated in any printhead and printer configuration. Referring to FIGS. 1 and 2 along with FIG. 4, the printhead assembly 150 is comprised of a thermal inkjet head assembly 402 and a printhead body 404. The thermal inkjet head assembly 402 can be a flexible material commonly referred to as a Tape Automated Bonding (TAB) assembly and can contain interconnect pads 412. The interconnect pads 412 are suitably secured to the printhead assembly 150 (also called a print cartridge), for example, by an adhesive material. The contact pads 408 align with and electrically contact electrodes (not shown) on the carriage assembly 130.

High Performance Nozzle Arrangement

Figure 5A:
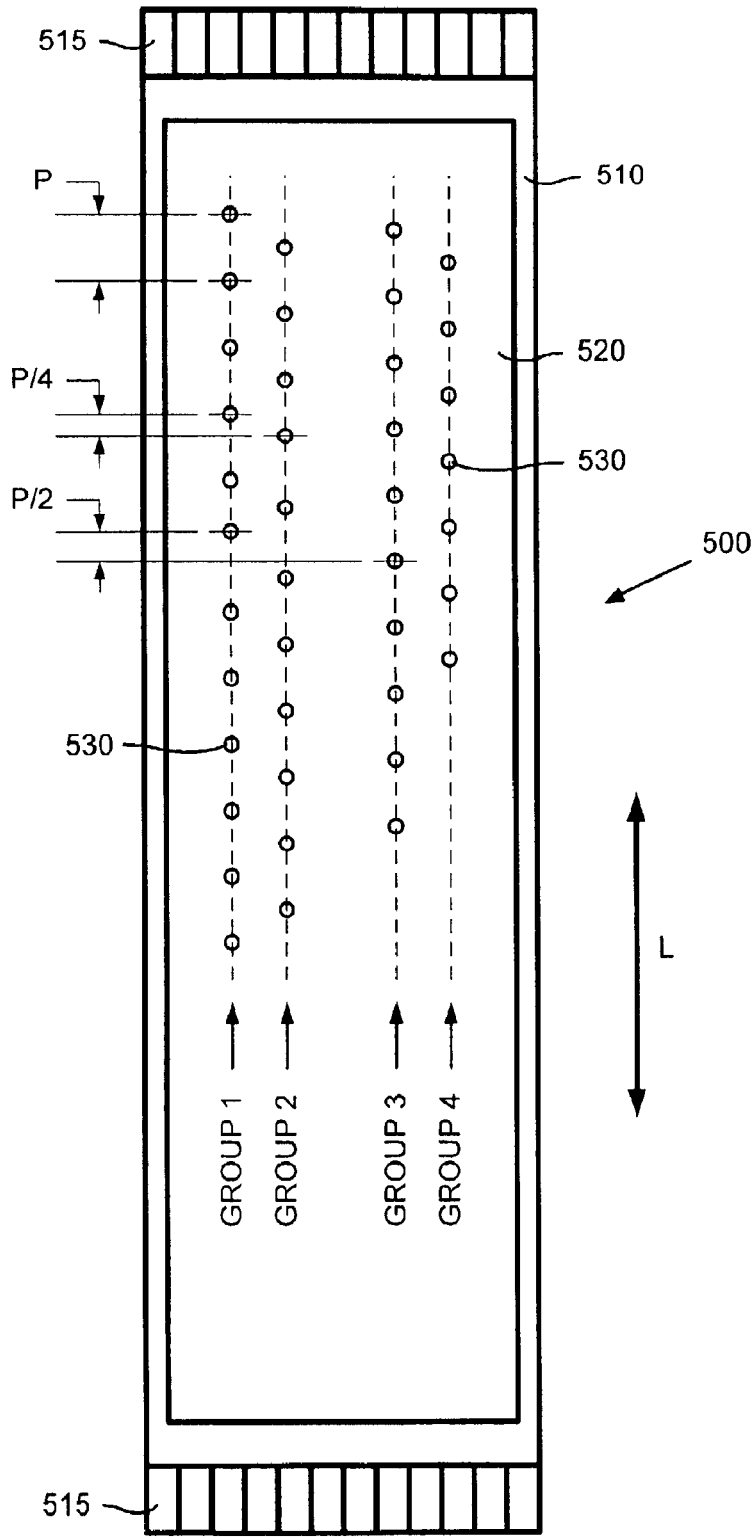
FIG. 5A is a plan view representation of an exemplary printhead of the present invention illustrating the arrangement of nozzles.

FIG. 5A is a plan view representation of an exemplary printhead of the present invention illustrating the arrangement of nozzles. It should be noted that FIG. 5A is a simplified illustration. For example, the number of nozzles illustrated has been greatly reduced from the exemplary or intended commercial embodiment. An exemplary printhead 500 includes a compact substrate 510 having a plurality of ink drop generators therein, input pads 515 and an orifice layer 520. The orifice layer 520 contains a plurality of nozzles 530 corresponding to the plurality of ink drop generators.

In an exemplary embodiment of FIG. 5A, the printhead has a combined nozzle resolution of approximately 1200 dots per inch (dpi). Stated another way, the combined (or effective) pitch of the printhead is $1/1200^{th}$ of an inch measured along a reference axis L. The nozzles of the printhead each operate with an operating frequency that can exceed 12 kHz.

To achieve a high print resolution, the exemplary printhead of the present invention as shown in FIG. 5A has the nozzles arranged into four axis groups (shown as Groups 1–4 in FIG. 5A). Each axis group has a centerline (shown as dashed lines in FIG. 5A) that is generally parallel to the centerlines of the other axis groups and to the reference axis L. In operation, the reference axis L is aligned with the media advance axis 227. Each axis group has a axis pitch P measured relative to the reference axis L. The nozzles from each axis group are staggered with respect to the nozzles of the other axis groups and relative to the reference axis L. As shown in FIG. 5A, each axis group has an axis pitch of P, and the effective pitch for the combination of all four axis groups is P/4 relative to reference axis L (or one-fourth of the pitch of any single axis group). Moreover, Group 1 and Group 3 may be combined to provide an effective pitch of P/2. Similarly, Group 2 and Group 4 may be combined to provide an effective pitch of P/2. In this exemplary embodiment, the axis pitch P of each axis group is $1/300^{th}$ of an inch, but this technique of staggering three or more axis groups to provide an increased resolution can be applied to any axis pitch. While the nozzles of each axis group are illustrated to be substantially collinear, it should be noted that some of the nozzles of an axis group may be slightly off the centerline of the axis group. This may occur, for example, when there is a need to compensate for firing delays.

Figure 5B:
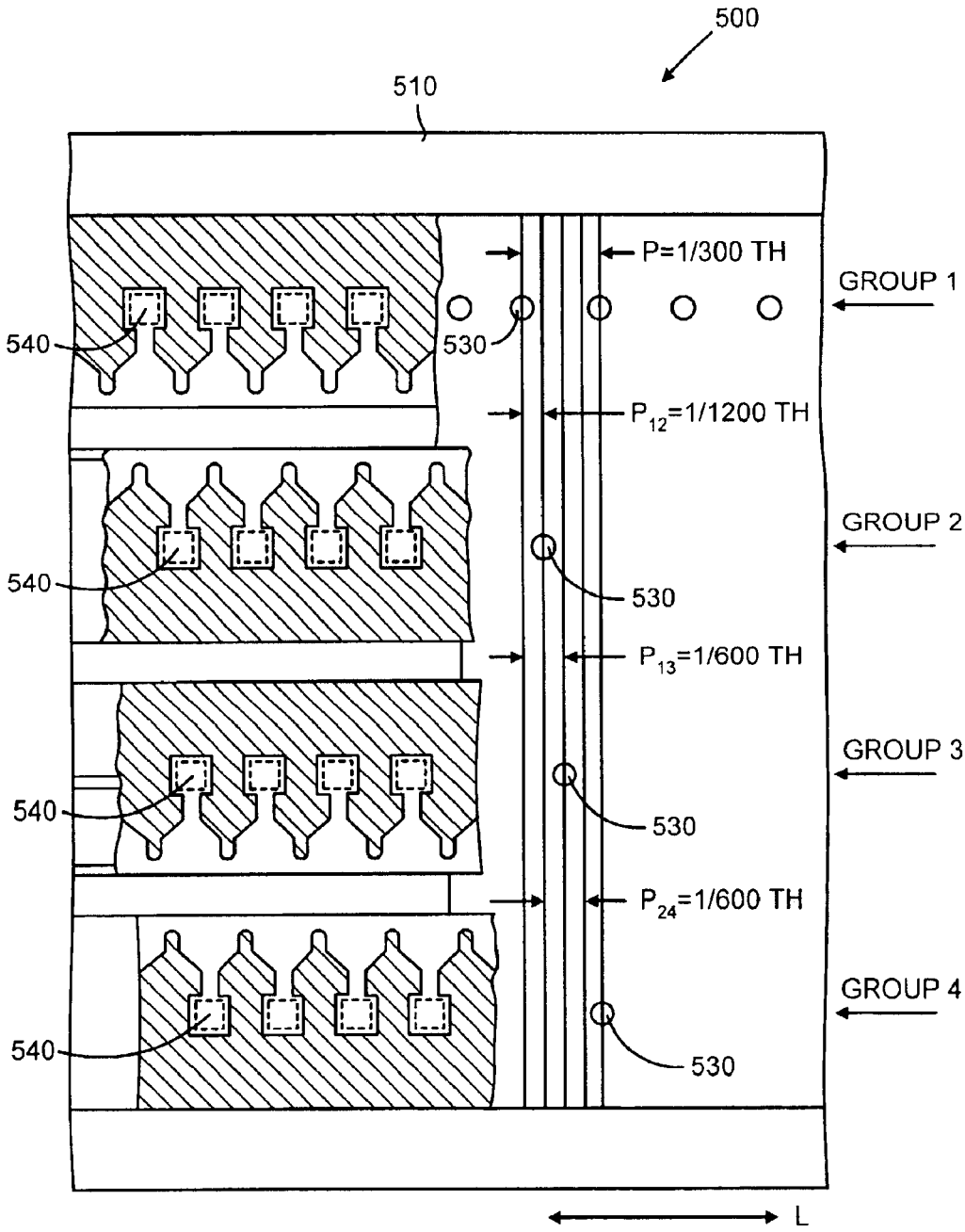
FIG. 5B depicts a plan view of a portion of the printhead of FIG. 5A with the orifice layer removed and illustrating the staggered arrangement of ink drop generators.

FIG. 5B depicts a plan view of a portion of the printhead of FIG. 5A with the orifice layer removed and illustrating the staggered arrangement of ink drop generators. Specifically, the printhead 500 includes ink drop generators 540 disposed on the compact substrate 510. The nozzles 530 overlying the ink drop generators 540 are arranged into axis groups, including Group 1, Group 2, Group 3 and Group 4. The axis groups of ink drop generators are spaced apart from each other transversely relative to the reference axis L. In a preferred embodiment, the reference axis L is aligned with the media advance axis 227. A single axis group of ink drop generators has a certain axis resolution defined as 1 divided by an axis pitch (1/P) for a single pass of the printhead 500 over the print media. In an exemplary embodiment, the axis resolution (1/P) is approximately 300 dpi. By using this staggered arrangement of axis groups, the effective resolution of the combined axis groups is increased to approximately 4/P when operating with all four axis groups, and approximately 2/P when operating with a properly selected pair of the four axis groups.

The axis pitch (P) of a particular of a particular axis group equals the center-to-center spacing between two nearest ink drop generators projected onto or measured according to the reference axis L. In a preferred embodiment, P is approximately equal to $1/300^{th}$ of an inch. Groups 1, 2, 3, and 4 are staggered relative to each other along reference axis L by P/4 (or $1/1200^{th}$ of an inch if P is approximately equal to $1/300^{th}$ of an inch) for any two axis groups that are nearest neighbors. As illustrated in FIG. 5B, this provides a combined center-to-center spacing (again measured along the reference axis L) equal to P/4 ($1/1200^{th}$ of an inch in an exemplary embodiment). With this arrangement, the combined center-to-center spacing of Groups 1 and 3 (denoted as P13) equals P/2, or $1/600^{th}$ of an inch. The combined center to center spacing of Groups 2 and 4 (denoted as P24) also equals P/2. This high-density staggered arrangement permits the printhead of the present invention to provide high-performance printing in a compact printhead design.

Figure 5C:
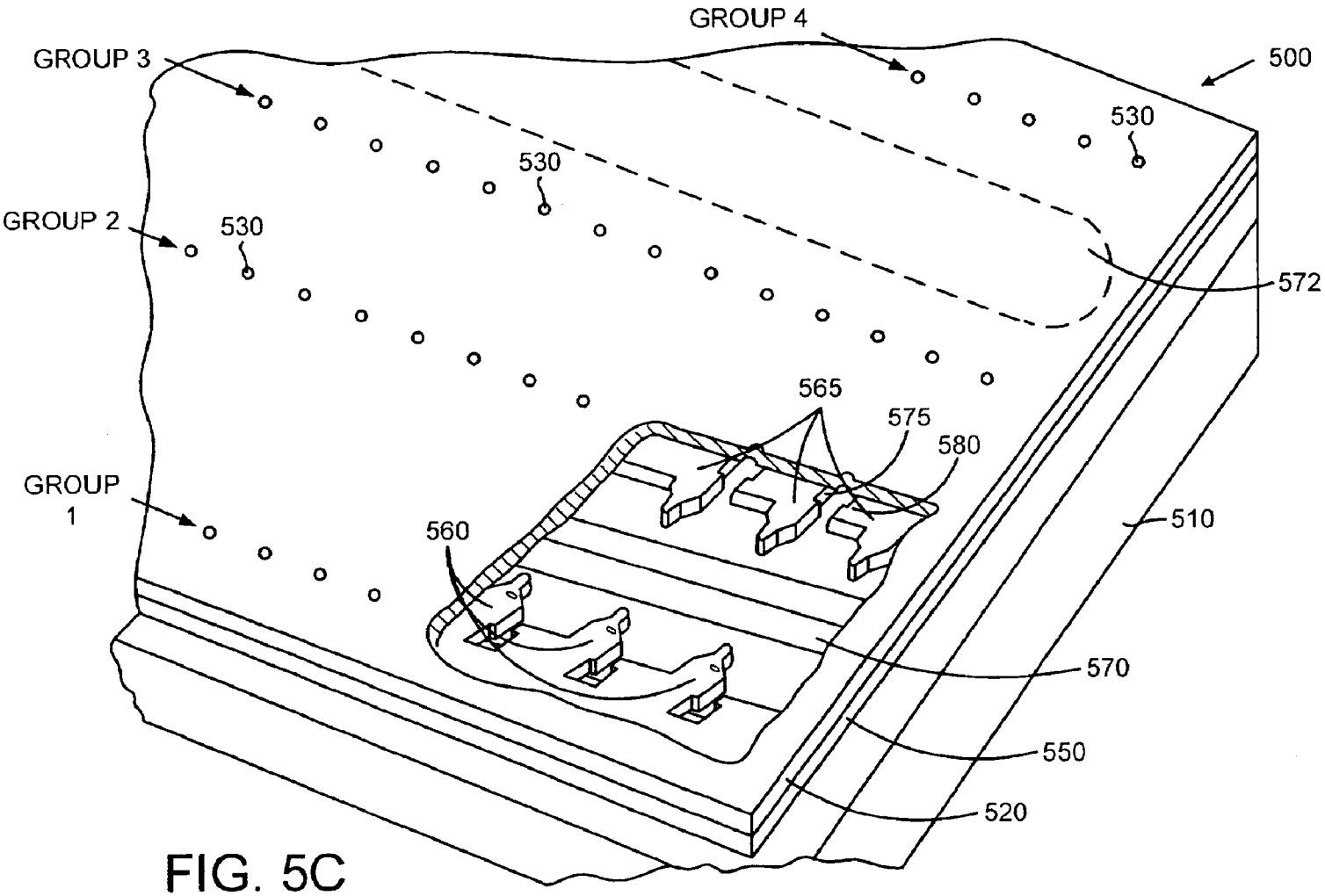
FIG. 5C is a cut-away isometric view of the printhead of FIG. 5A illustrating the various layers of the printhead.

FIG. 5C is a cut-away isometric view of the printhead 500 of FIG. 5A illustrating the various layers of the printhead 500. The printhead 500 includes the compact printhead substrate 510 (such as silicon) and having various devices and thin film layers formed thereon. The printhead 500 also includes the orifice layer 520 disposed on a barrier layer 550 that in turn overlays the substrate 510. The substrate 510 includes ink drop generators that are arranged in a high-density, staggered arrangement including a first plurality of ink drop generators 560 within Group 1 and a second plurality of ink drop generators 565 within Group 2 arranged around a first ink feed slot 570. In this exemplary embodiment, a second ink feed slot 572 is provided whereby Group 3 and Group 4 are arranged around the second ink feed slot 572. Nozzles 530 are formed into the orifice layer 520 and arranged such that each nozzle 530 has an underlying ink drop generator. Ink is supplied through the first ink feed slot 570 to the ink drop generators where it is heated and ejected through the nozzles 530.

A lamination process is typically used to attach the orifice layer 520 to the barrier layer 550. Although FIG. 5C depicts the barrier layer 550 and orifice layer 520 as being separate discrete layers, they can also be formed in an alternative embodiment as one integral barrier and orifice layer. A firing chamber 575 is defined by both the orifice layer 520 and the barrier layer 550 together. The firing chamber 575 is where ink is heated by a resistor 580 until the drop is expelled through the nozzle 530.

Compact, Elongate Printhead Substrate

The present invention includes a high-density arrangement of ink drop generators disposed on a compact printhead substrate. The printhead has an elongate (or narrow width) shape and, in a preferred embodiment, the compact printhead substrate is a rectangle having a width of approximately 3 millimeters and a length of approximately 12 millimeters. Contained on this compact printhead substrate is at least 350 nozzles with a preferred number of 416 nozzles. In a preferred embodiment, the result is a compact printhead having approximately 12 nozzles per square millimeter.

Ink drop generators contained on the printhead substrate eject ink from nozzles that are arranged in at least four staggered rows having 104 nozzles each, with each row of nozzles about ⅓ of an inch in length. The four rows of nozzles are arranged in pairs around two elongate ink feed slots, with each ink feed slot having a width of approximately 200 microns. Preferably, each ink feed slot is located approximately 680 microns from the center of the printhead.

Figure 6:
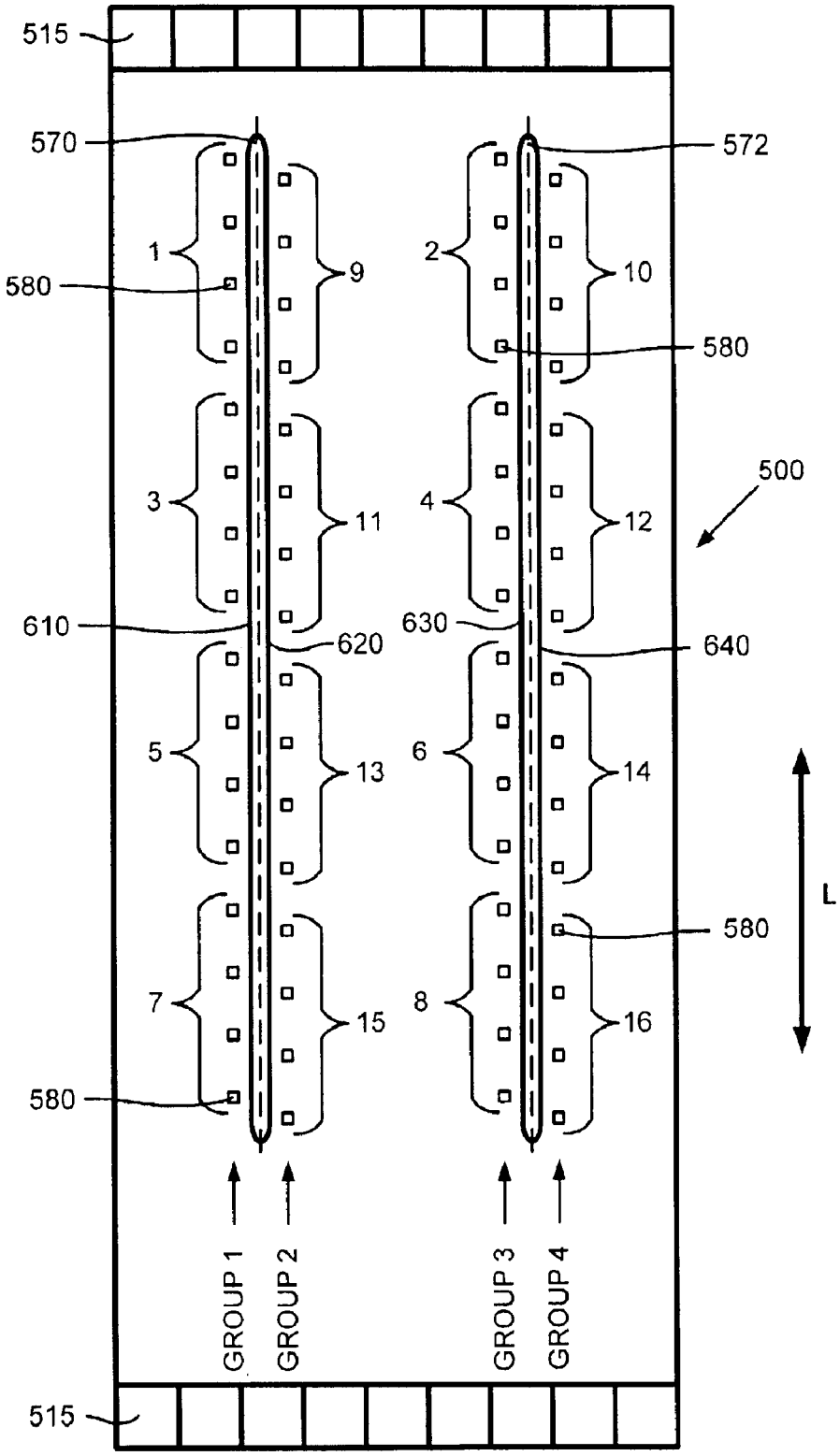
FIG. 6 is a plan view representation of the exemplary printhead of FIG. 5 with the nozzle layer of the printhead removed and revealing the pattern of resistors that underlie the nozzles.

FIG. 6 is a plan view representation of the exemplary printhead of FIG. 5 with the nozzle layer of the printhead removed and revealing the pattern of resistors 580 that underlie the nozzles. Each nozzle of the present invention has a corresponding and underlying operable resistor 580. The number of resistors illustrated in FIG. 6 has been reduced for purposes of simplifying the illustration.

The resistors 580 are arranged on a highly compact printhead substrate 510 such that a density of resistors is at least 10 resistors per square millimeter of the printhead substrate 510. This high-density arrangement allows the cost of the printhead to be lower than many other printheads having fewer nozzles. In an exemplary embodiment, there are approximately 12 resistors per square millimeter of the printhead substrate 510. It should be noted that the area of any ink feed slots is included in a calculation of the resistor density.

The printhead substrate 510 as shown in FIG. 6 has an elongate form factor, with a length of the substrate 510 generally aligned with the reference axis L. In a preferred embodiment, at least 350 ink drop generators are arranged upon the substrate 510 having a width of less than approximately 3 millimeters and a length of less than approximately 12 millimeters. In a preferred embodiment, the substrate 510 contains 416 resistors and has a width of approximately 2.9 millimeters and a length of approximately 11.5 millimeters.

The printhead substrate 510 has two elongate ink feed slots including the first ink feed slot 570 and the second ink feed slot 572. Each of the ink feed slots 570, 572 provides ink from an ink supply device to resistors 580 in two axis groups. For example, as shown in FIG. 6, the first ink feed slot 570 provides ink to resistors in Groups 1 and 2 and the second ink feed slot 572 provides ink to resistors in Groups 3 and 4. Each of the ink feed slots 570, 572 has a centerline (shown as dashed lines in FIG. 6) that is generally parallel to the reference axis L and approximately divides each of the ink feed slots 570, 572 equally along their respective lengths. The centerlines of the ink feed slots 570, 572 are spaced apart and transverse from each other in a direction approximately parallel to the reference axis L. Each of the ink feed slots 570, 572 has two longitudinal edges that generally are the length of the slot. In particular, the first ink feed slot 570 includes a first longitudinal edge 610 adjacent which are arranged Group 1 resistors and a second longitudinal edge 620 adjacent which are arranged Group 2 resistors. Similarly, the second ink feed slot 572 includes a third longitudinal edge 630 and a fourth longitudinal edge 640 having Groups 3 and 4 adjacent the respective edge.

At opposite ends of the length of the printhead substrate 510 are end portions having input pads 515 that provide energy for the resistors of each axis group. Switching circuitry (such as a plurality of transistors) couples signals being delivered from the input pads 515 to the resistors in the axis groups. This technique helps to reduce the width of the printhead substrate 510.

Each of the resistors 580 is coupled to a switching circuit (such as a field effect transistor (FET)) that provides current pulses to the resistor 580. These switching circuits are discussed in detail below. The resistors 580, along with their respective switching circuits, are arranged into groupings called primitives (as shown in FIG. 6 as by the numerals 1–16). In an exemplary embodiment shown in FIG. 6, each of the axis groups is divided into 4 primitives. Preferably, each of the primitives each has 26 nozzles, for a total of 104 nozzles per axis group. Although for the purpose of simplicity FIG. 6 illustrates only four resistors (and corresponding ink drop generators) per primitive, it is understood that most printhead designs will tend to have greater than 10 resistors (and ink drop generators) per primitive.

Low Ink Drop Weight

Preferably, the high-density arrangement of ink drop generators uses low-weight ink drops. A low-weight ink drop is smaller and provides a finer resolution print than is achieved with higher weight ink drops. Using low-weight ink drop with a high-density array of ink drop generators provides the present invention with high print resolution at high print speeds. In a preferred embodiment, the present invention uses black ink drops that weigh approximately 15 nanograms (ng), with preferred range of from 14 to 16 ng.

High Ejection Frequency

In general, a preferred embodiment of the present invention operates the ink drop generators at a high ejection frequency in order to facilitate the use of low-weight ink drops and still maintain a high print speed. Preferably, this ejection frequency is in the kilohertz (kHz) range. This high ejection frequency combined with the high-density array of ink drop generators provides high-speed printing with high resolution.

In a preferred embodiment, the ink drop generators of the present invention use an ejection frequency in excess of 12 kHz. A preferred frequency range is approximately from 15 to 18 kHz, with 18 kHz as the preferred value.

Printhead Circuitry

The present invention includes a high-performance yet economical printhead that uses a compact design to decrease cost and is thermally efficient to allow the high-performance design to be used on a compact printhead substrate. In particular, the thermally-efficient design of the printhead enables a high density of ink drop generators to be placed on a compact printhead substrate while minimizing thermal excursions. One way the present invention enables a high-performance yet compact design involves printhead circuitry. Specifically, the printhead circuitry is designed such that low power is required to operate each ink drop generator and a minimum of thermal energy is produced.

One technique includes providing a particular primitive with a primitive power lead (that provides power to the particular primitive) that is separately energizable from each of the primitive power leads for each of the remaining primitives. Thus, a particular primitive power lead is coupled to all of the primitive power leads associated with each of the switching circuits within a particular primitive. In a preferred embodiment where the switching circuits are FETs, the particular primitive select lead is coupled to each of the source or drain connections for each FET within the particular primitive.

Another technique of the invention concerns separately energizable gate leads with each gate lead coupled to a single switching device of each of a plurality of primitives. The number of gate leads is 1 to N (where N is the number of resistors in the largest primitive). In a preferred embodiment, the primitives each have 26 resistors (N=26) and thus there are 26 gate leads. When the switching devices are FETs, each FET in a primitive has one of the gate leads connected to its gate. When a particular switching device is activated a current pulse flows from a primitive power lead, through the switching circuit, through the heater resistor, and back through a return or ground lead. In order for a particular switching device to be activated, the gate lead and the primitive power lead associated with that switching device must be simultaneously activated or energized.

During printhead operation, the gate leads are activated one at a time and in sequence. As a result, only one switching device in a particular primitive can be activated at a time. However, some or all of the primitives can be operated simultaneously since each gate lead is connected to one switching device of a plurality of primitives. In a preferred embodiment, each primitive has at most one gate connection for each of the 26 gate leads. Since the printing system cycles through gate leads during operation, only one ink drop generator can be operated at a time within a primitive. However, since most gate leads are shared by the primitives, multiple primitives can be fired simultaneously. In a preferred embodiment, there are at least three and preferably four primitives that overlap in the scan axis (that is transverse to the paper axis and transverse to axis L) that can be operated simultaneously. This allows for much more complete and higher resolution coverage in a single scan.

Figure 7:
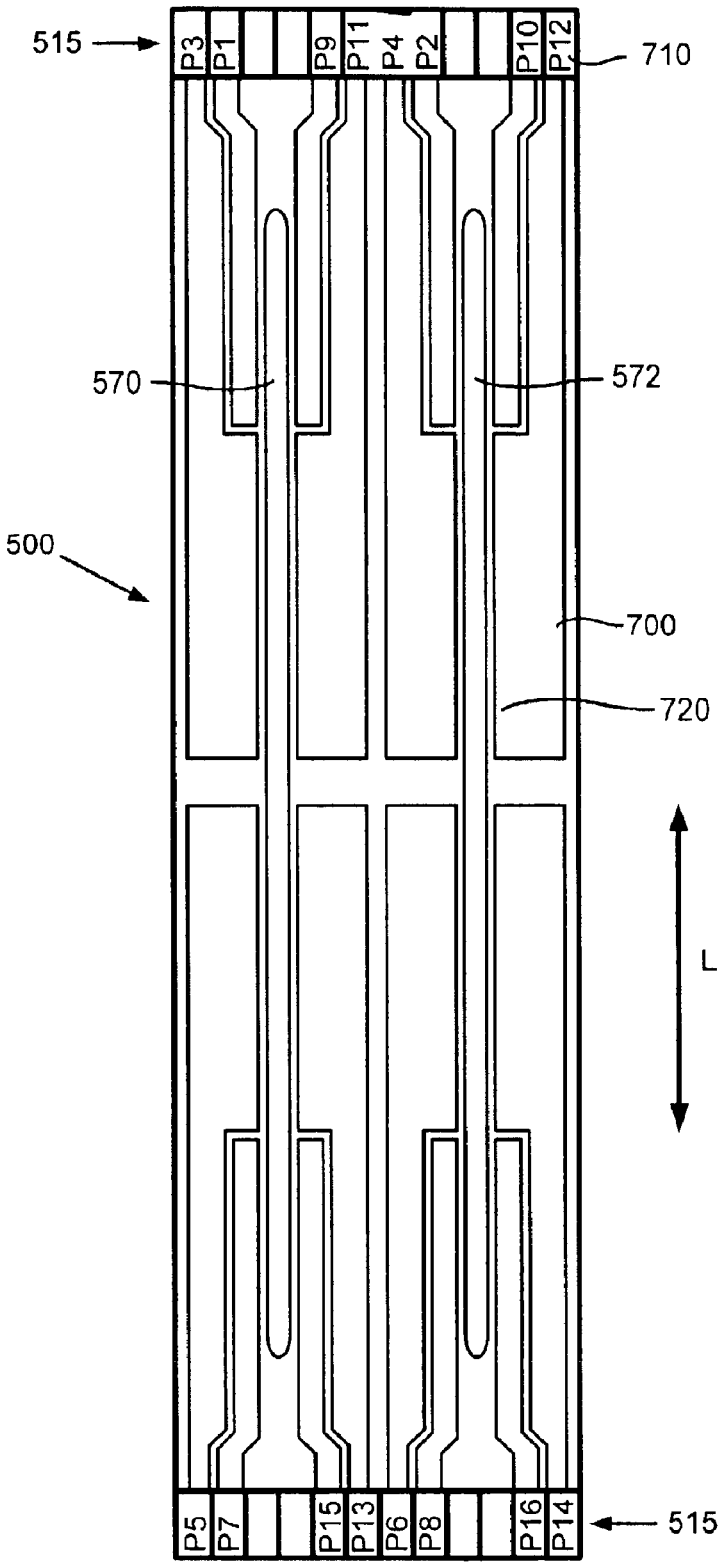
FIG. 7 is an exemplary embodiment of primitive power routing for the printhead 500 shown in FIG. 5A.

FIG. 7 is an exemplary embodiment of primitive power routing for the printhead 500 shown in FIG. 5A. For a particular primitive, there is a primitive power lead that is coupled at a first end to a corresponding primitive contact pad that is one of the input pads 515 (shown as P1–P16 in FIG. 7) and coupled along an edge to the switching devices corresponding to that particular primitive power lead. For example, as shown in FIG. 7, primitive 12 has a primitive power lead 700 coupled at a first end as a primitive 12 contact pad 710 (on the far right side of the top row of input pads 515) and along an edge 720 coupled to the switching devices of primitive 11 (not shown). In an exemplary embodiment, each primitive power lead is connected to either the source or drain connection for each FET within that primitive. These contact pads (P1–P16) are used to input the energy required to energize each of the primitives on the printhead 500.

Figure 8A:
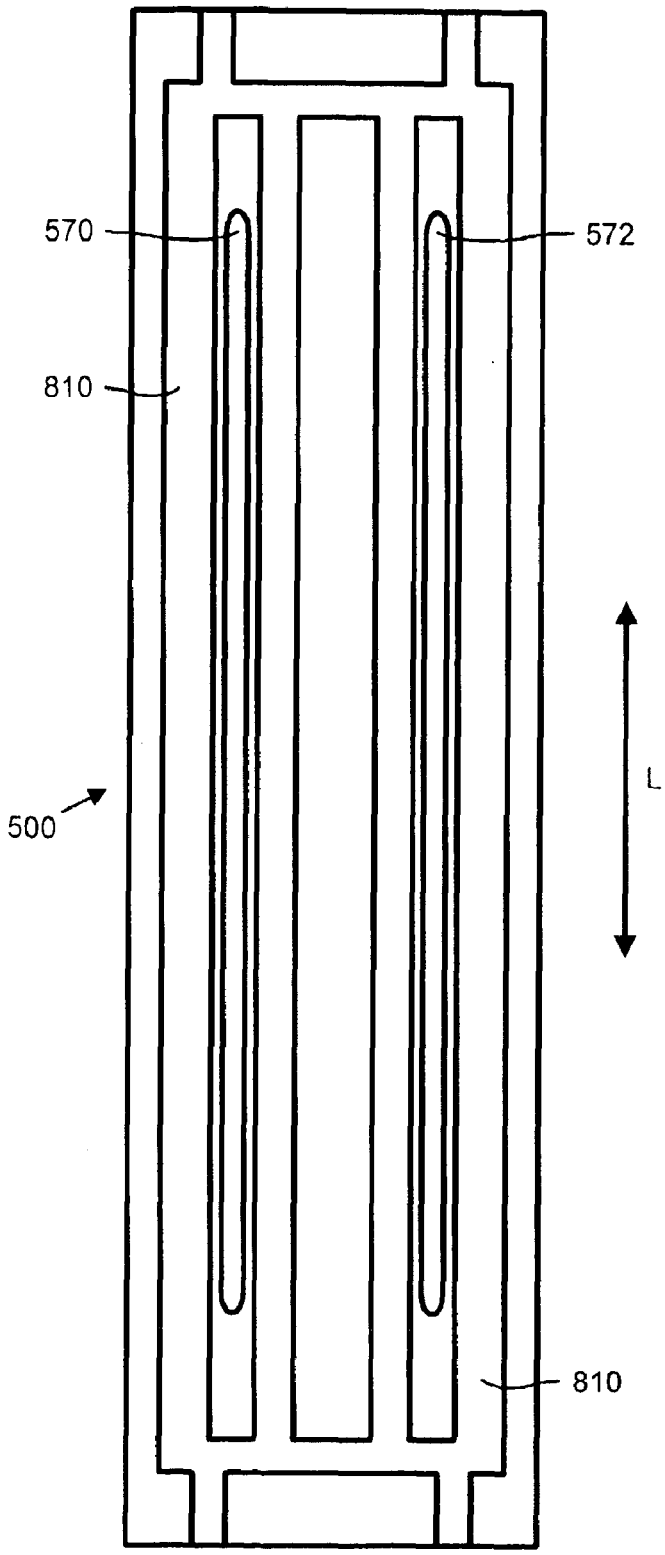
FIG. 8A is one exemplary embodiment illustrating a single ground connection lead for the printhead shown in FIG. 5A.
Figure 8B:
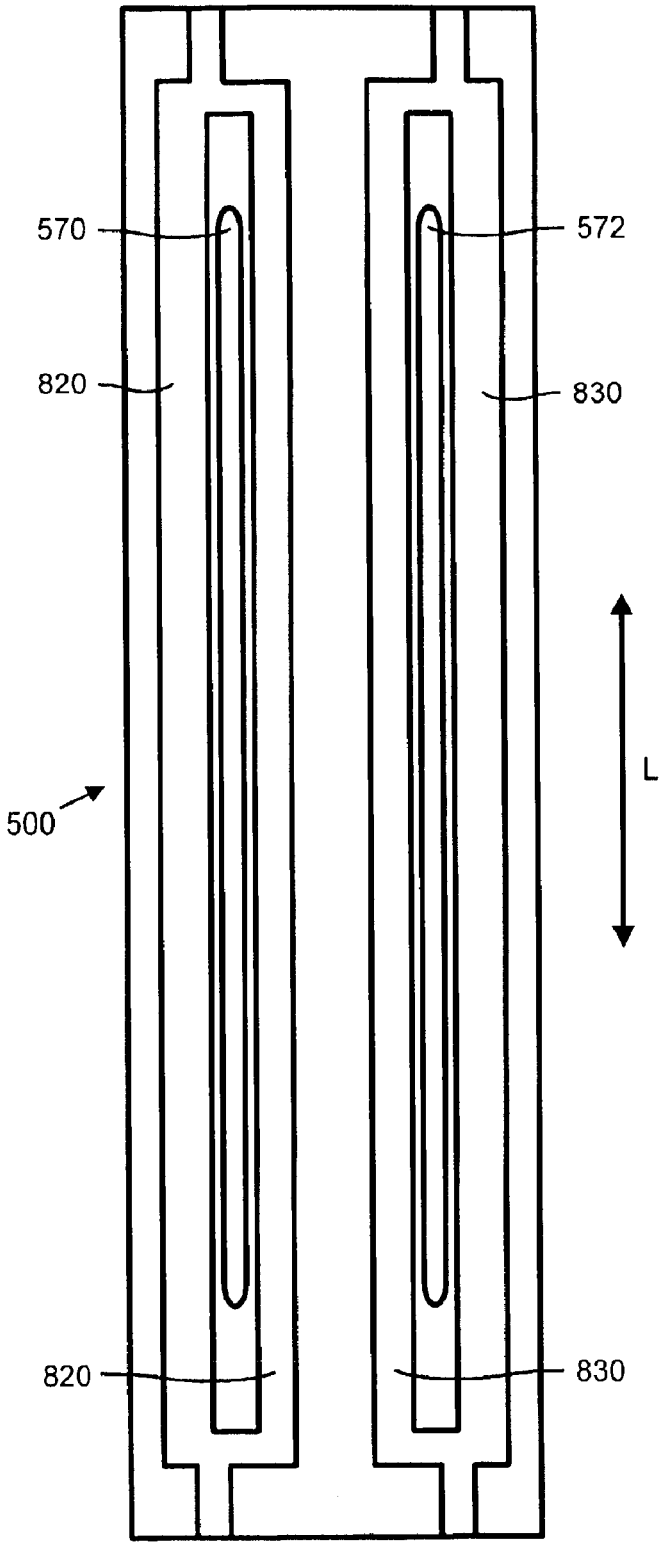
FIG. 8B is another exemplary embodiment illustrating two ground connection leads for the printhead shown in FIG. 5A.

FIGS. 8A and 8B illustrate two embodiments of ground connection leads for of the printhead 500 of the present invention. As discussed previously, each of the ink feed slots 570, 572 has two longitudinal edges. Adjacent to each longitudinal edge is one of the four axis groups of resistors. To reduce the number of input pads 515, more than one primitive shares the same ground connection lead. In both the embodiment of FIGS. 8A and 8B, the two ends of each axis group are commonly connected to reduce the ground lead parasitic resistance difference between resistors near the center of the compact printhead substrate 510 relative to the ends of the substrate 510.

FIG. 8A is one exemplary embodiment illustrating a single ground connection lead for the printhead 500 shown in FIG. 5A. In this embodiment, a single ground connection lead 810 is used to connect to all 16 primitives to ground. Thus, all 16 primitives are connected by a single ground connection lead to ground. Alternatively, FIG. 8B is another exemplary embodiment illustrating two ground connection leads for the printhead 500 shown in FIG. 5A. In this particular embodiment there is a first ground connection lead 820 and a second ground connection lead 830. Each of the two ground connection lead 820, 830 connect all the primitives of around particular ink feed slot to ground. For example, as shown in FIG. 8B, the first ground connection lead 820 connects the primitives around the first ink feed slot 570 to ground and the second ground connection lead 830 connects the primitives surrounding the second ink feed slot 572 to ground.

Thermally-Efficient Thin Film Resistor Structure

Each of the ink drop generators of the present invention is thermally efficient to enable the ink drop generators to be packed onto the compact printhead substrate at a high density. In order to achieve this thermal efficiency, each ink drop generator includes a thin-film resistor structure that decreases the power required for each resistor. In particular, the present invention uses high-resistance resistors to reduce the power required to energize the resistor and a thin passivation layer to reduce the input power dissipated due to parasitic energy dissipation. Both resistor structures facilitate using high-frequency printing bursts in the printing system by reducing the power requirements of the printhead and eliminating a major increase in thermal energy due to an increased power requirement. In other words, reducing the power requirement enables less power to be used by the printhead even though there are more resistors, thereby allowing the printhead to operate at a lower temperature and reducing thermal excursions.

Figure 9:
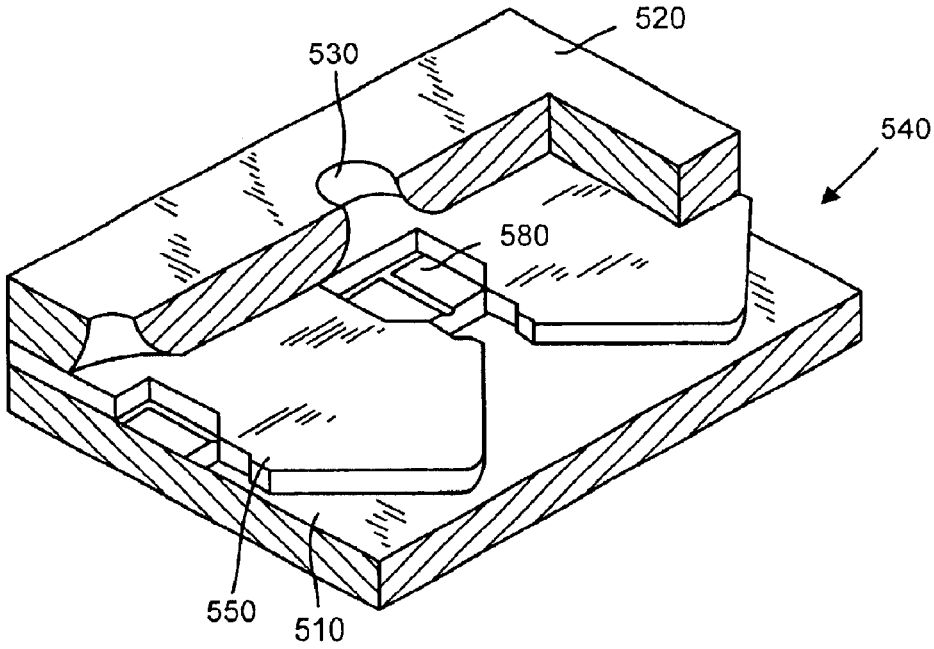
FIG. 9 is a cut-away perspective view of an exemplary ink drop generator of the present invention.

In particular, FIG. 9 is a cut-away perspective view of an exemplary ink drop generator of the present invention. The ink drop generator 540 is disposed on a compact printhead substrate 510 and includes a thin-film resistor structure 580 (shown in greater detail in FIGS. 10A and 10B). Overlying the resistor structure 580 is the barrier layer 550 and an orifice layer 520, both discussed further below. The top of the thin-film resistor structure 580 and the barrier and orifice layers 550, 520 form a firing chamber where ink is vaporized by the resistor structure 580 and ejected through an orifice (such as a nozzle 530). Preferably, the orifice diameter is within a range of between about 10 to 20 microns, with an exemplary value of approximately 16 microns. Each component and layer of the ink drop generator 540 may be formed separately or integrally and various methods for forming these components and layers are known in the art. For example, the barrier and orifice layers 550, 520 can be applied separately or formed integrally and then applied to the underlying compact printhead substrate 510.

One technique used by the present invention to reduce thermal excursions is to decrease the power required to fire a resistor 580 by increasing the resistance of the firing resistors 580 so that the ratio of connecting trace resistance (or parasitic resistance) to total resistance is decreased. This resistance ratio is directly related to power dissipated in the connecting traces, and is known as the "parasitic power loss. Each resistor 580 has connecting traces that connect the resistor 580 to various electrical connections. In conventional designs, the resistance of the connecting traces may be up to one-third or greater of the firing resistor 580 resistance. This parasitic power loss can cause up to one-third of the input energy to be dissipated within the connecting traces. Parasitic power loss becomes even more significant in the present invention because there is a high resistor density (the number of resistors per unit area of the compact printhead) and there is less room for the connecting traces and a greater total power requirement.

The present invention decreases the parasitic power loss by increasing the resistance of each firing resistor 580 thereby decreasing the power dissipated within the connecting traces. Preferably, the resistance of each firing resistor 580 is at least 70 ohms with a preferred value of over 100 ohms. Higher resistance may be achieved by reducing the thickness of the resistor 580 or by using a resistor material of higher resistivity. In a preferred embodiment, however, the thickness of the resistor and resistivity of the resistor material are unchanged and the resistor path length is increased to obtain a higher resistance. This is achieved by splitting the resistor body into a plurality of segments that are connected in series by a coupling device or conducting link. This split resistor increases the resistance of the firing resistor 580 because the resistance of each segment is added to the previous segment in the series. An increase in the resistor resistance also increases the total resistance (while keeping the connecting trace resistance nearly constant) and thereby decreases the parasitic power loss (the ratio of trace resistance to the total resistance).

Figure 10A:
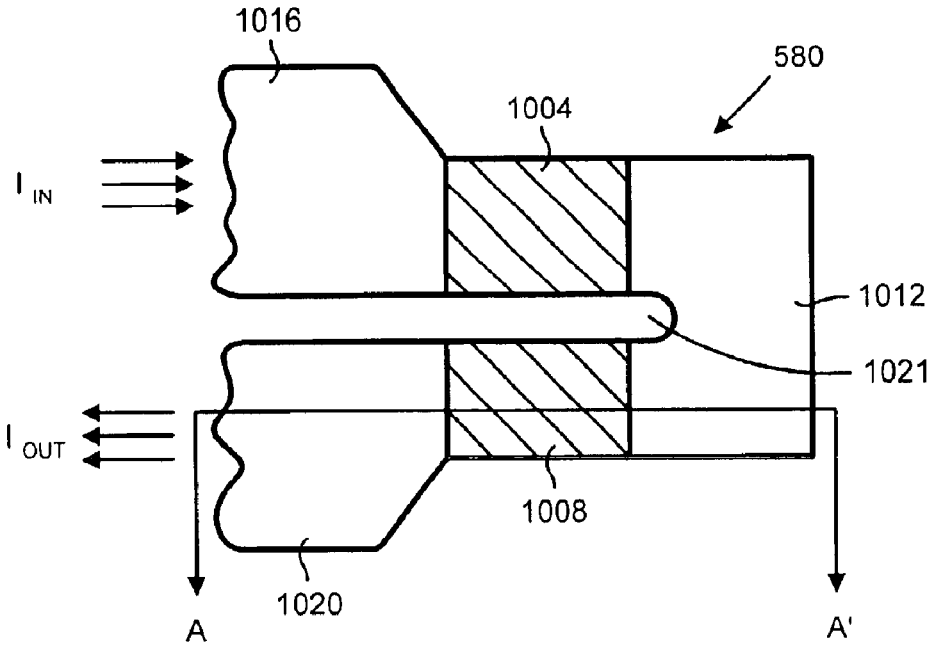
FIG. 10A is a plan view of firing resistor shown in FIG. 9.

FIG. 10A is a plan view of firing resistor shown in FIG. 9. In this exemplary embodiment, the firing resistor 580 comprises a first segment 1004 and a second segment 1008 that are connected in series by a coupling device or conductor 1012. An input pad 1016 for receiving electrical signals is located adjacent the first segment 1004 and an output pad 1020 for transmitting electrical signals is located adjacent the second segment 1008. In this preferred embodiment, a current control device 1021 is used to reduce current crowding that would otherwise occur in the coupling device 1012. This current control device 1021 interrupts an otherwise straight current path through the coupling device 1012. In the exemplary embodiment shown in FIG. 10A, the current control device 1021 is a notch 1021 formed in the coupling device 1012 between the first segment 1004 and the second segment 1008.

In this exemplary embodiment, each segment 1004, 1008 is approximately 24 microns long and 13 microns wide. This provides a total of approximately four squares, with each square having a resistance of about 29 ohms, resulting in a total resistance of 130 ohms (including the connecting traces). Preferably, the parasitic resistance is approximately in the range between about 7 to 8 percent and is tuned for an ink drop weight of about 5 nanograms (ng). Alternatively, a resistance of at least 80 ohms would result in a parasitic resistance of approximately 12 percent. The width of a gap 1022 between the opposing segment is approximately 3 microns.

Another technique used by the present invention to improve thermal efficiency is to reduce the thermal resistance of a passivation layer on the thin-film resistor structure 580. A thinner passivation layer means that less energy is required to energize the resistor. This means that less thermal energy needs to be dissipated from the ink drop generator and results in better thermal efficiency. The present invention accomplishes this by reducing the thickness of the passivation layer to allow a minimum amount of energy to energize the resistor 580 and cause an ink drop to be ejected. Preferably, with the thinner passivation layer, energies of less than 1.4 microjoules are required to energize the resistor 580, with a preferred energy range being between about 0.8 to 1.0 microjoules. The power required to energize the resistor 580 is also affected by ratio of trace resistance to total resistance (parasitic power loss), with a lower parasitic power loss generally meaning that less power is required. The present invention preferably reduces thermal excursions on the printhead by using both a low ratio of trace resistance to total resistance (a low parasitic power loss) and a thinner passivation layer.

Figure 10B:
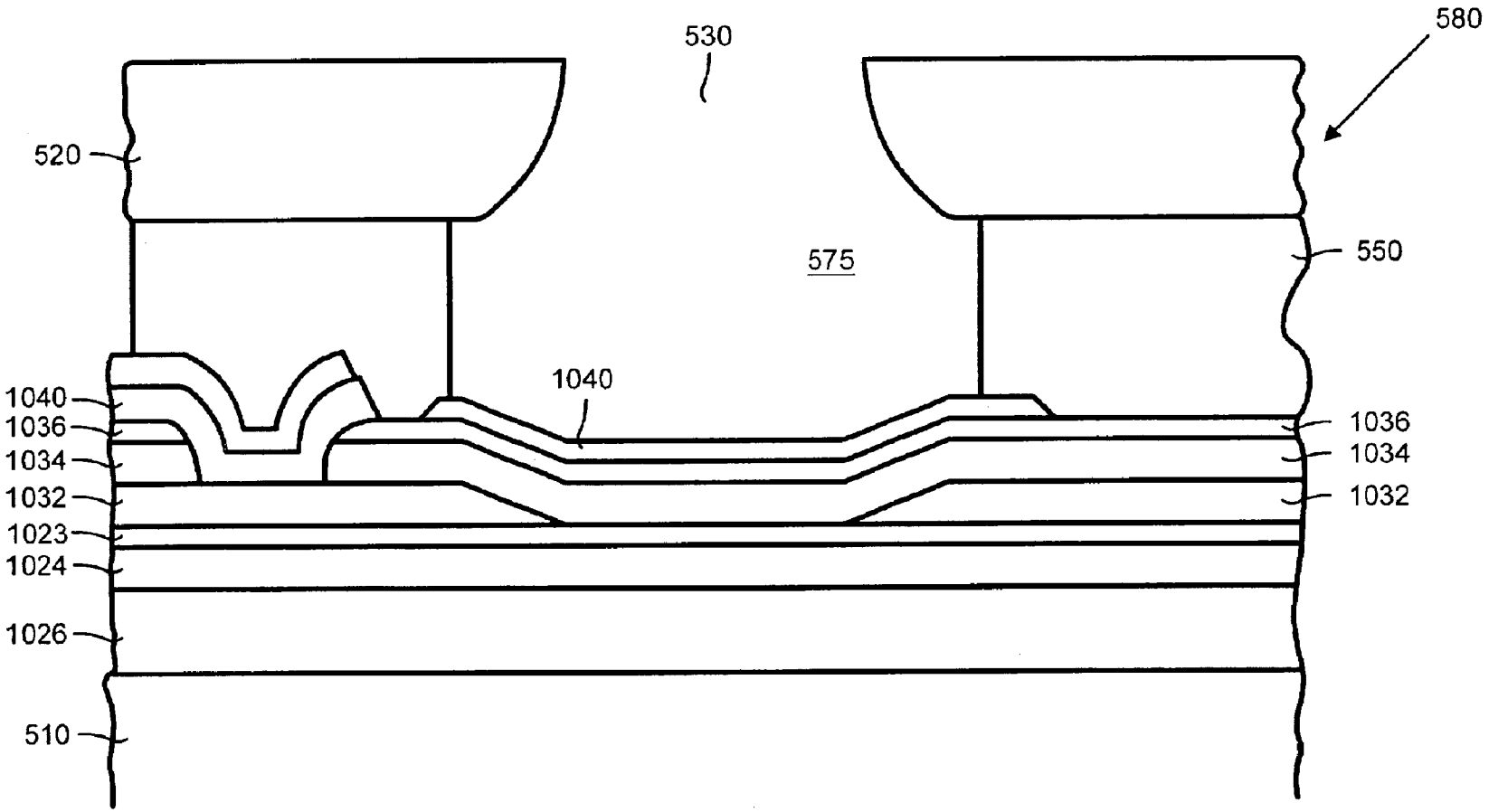
FIG. 10B is a side view of the firing resistor of FIG. 10A illustrating the thin-film structure of the firing resistor.

FIG. 10B is a side view of the firing resistor of FIG. 10A showing the thin-film structure of the firing resistor 580. FIG. 10B is a cross-section along AA' from the resistor 580 shown in FIG. 10A. In this exemplary embodiment, the resistor layer 1023 is made of Ta Al and overlies a layer of PSG 1024 and FOX 1026 disposed on the compact printhead substrate 510 (preferably made of silicon). In a preferred embodiment the resistor layer 1023 is approximately 900 angstroms thick. Overlying a portion of the resistor layer 1023 is a conductor layer 1032 comprised of AlSiCu.

The resistor layer 1023 is protected from damage by a first passivation layer 1034 comprised of $Si_3N_4$ and a second passivation layer 1036 comprised of SiC. In a preferred embodiment, the thickness of the first passivation layer 1034 is 2570 angstroms and the thickness of the second passivation layer 1036 is 1280 angstroms. The combination of the first passivation layer 1034 and the second passivation layer 1036 comprise a total passivation layer. Preferably, the total passivation layer is kept to a thickness of less than about 5000 angstroms with a preferred range between about 3500 to 4500 angstroms. At this passivation layer thickness the energy required to energize the resistor layer 1023 is less than 1.4 microjoules.

Overlying the second passivation layer 1036 is a cavitation layer 1040 that protects the resistor layer 1023 and passivation layers 1034, 1036 from damage due to ink drop cavitation and collapse. Preferably, the cavitation layer 1040 is comprised of tantalum (Ta) having a thickness of 3000 angstroms. The barrier layer 550 (preferably approximately 14 microns thick) and the orifice layer 520 (preferably approximately 25 microns thick) overlie the cavitation layer 1040. The cavitation layer 1040, barrier layer 550 and orifice layer 520 create the firing chamber 575 where ink is vaporized by the resistor layer 1023 and ejected from the nozzle 530 created in the orifice layer 520.

The foregoing description of the preferred embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description of the invention, but rather by the claims appended hereto.

What is claimed is:

1. An ink cartridge comprising:

a printhead substrate;

an ink supply containing a single color of ink;

a first plurality of ink drop generators formed in the printhead substrate and arranged along a first axis to form a first axis group;

a second plurality of ink drop generators formed in the printhead substrate and arranged along a second axis to form a second axis group and staggered with respect to the first axis group; and a third plurality of ink drop generators formed in the printhead substrate and arranged along a third axis to form a third axis group and staggered with respect to the first and second axis groups;

wherein the first, second and third plurality of ink drop generators receive the single color of ink from the ink supply and are mutually parallel and spaced apart transverse to one another.

2. The ink cartridge of claim 1, wherein the printhead substrate has a density of greater than approximately ten ink drop generators per square millimeter.

3. The ink cartridge of claim 1, wherein the printhead substrate includes at least three-hundred fifty ink drop generators.

4. The ink cartridge of claim 1, wherein the plurality of ink drop generators are disposed on the printhead substrate in a compact area, wherein the compact area has a length of less than approximately twelve millimeters and a width of less than approximately three millimeters.

5. The ink cartridge of claim 1, wherein each of the axis groups of ink drop generators is grouped into a plurality of primitives with each of the primitives commonly coupled to a single ground lead on the printhead substrate.

6. A fluid ejection device including an ink supply device for providing ink of a certain color, comprising:

a printhead substrate having two ink feed slots coupled to the ink supply device;

a single ground lead connected to an electrical ground; and a plurality of ink drop generators all connected to the single ground lead and being fluidically coupled to the two ink feed slots and formed in the printhead substrate, the plurality of ink drop generators being arranged in at least four staggered axis groups along axes that are approximately parallel and spaced transverse to each other substrate;

wherein the plurality of ink drop generators include high resistance resistors that have low thermal impedance protection layers to minimize an amount of thermal energy transferred to the printhead substrate per generated drop.

7. The fluid ejection device of claim 6, wherein each of the ink feed slots has two longitudinal edges and wherein one of the four axis groups of resistors is adjacent to each longitudinal edge.

8. The fluid ejection device of claim 6, wherein two ends of each axis group are commonly connected to reduce ground lead parasitic resistance difference between resistors near a center of the printhead substrate relative to ends of the printhead substrate.

9. The fluid ejection device of claim 6, wherein the density of ink drop generators is between approximately eleven and thirteen ink drop generators per square millimeter of the printhead substrate.

10. The fluid ejection device of claim 6, wherein each one of the plurality of ink drop generators includes a firing resistor having a resistance of at least seventy ohms.

11. The fluid ejection device of claim 6, wherein the plurality of ink drop generators arranged along the axes are staggered with respect to each of the axes to decrease an effective printhead pitch to approximately one-fourth that of a plurality of ink drop generators arranged along a single axis.

12. The fluid ejection device of claim 6, wherein each of the at least four axis groups of ink drop generators includes at least one-hundred ink drop generators.

13. The fluid ejection device of claim 6, wherein the plurality of ink drop generators operates at an ejection frequency of greater than approximately twelve kilohertz.

14. The fluid ejection device of claims 6, wherein the printhead substrate includes at least three-hundred fifty ink drop generators.

15. A fluid ejection device including an ink supply device for providing ink of a certain color, comprising:

a printhead substrate having first and second ink feed slots coupled to the ink supply device;

first and second ground leads connected to an electrical ground; and a plurality of ink drop generators fluidically coupled to the first and second ink feed slots and formed in the printhead substrate, the plurality of ink drop generators being arranged in at least four staggered axis groups along axes that are approximately parallel and spaced transverse to each other substrate, wherein at least two of the axis groups surround the first ink feed slot and at least two of the axis groups surround the second ink feed slot;

wherein the first ground connection lead connects the ink drop generators surrounding the first ink feed slot to the electrical ground and the second ground connection lead connects the ink drop generators surrounding the second ink feed slot to electrical ground.

16. The fluid ejection device of claim 15, wherein the plurality of ink drop generators arranged along the axes are staggered with respect to each of the axes to decrease an effective printhead pitch to approximately one-fourth that of a plurality of ink drop generators arranged along a single axis.

17. The fluid ejection device of claim 15, wherein the printhead substrate includes at least four hundred ink drop generators.

18. The fluid ejection device of claim 15, wherein the density of ink drop generators is between approximately eleven and thirteen ink drop generators per square millimeter of the printhead substrate.

19. The fluid ejection device of claim 15, wherein each of the at least four axis groups of ink drop generators includes at least one-hundred ink drop generators.

20. The fluid ejection device of claim 15, wherein the plurality of ink drop generators operates at an ejection frequency of greater than approximately twelve kilohertz.

* * * * *

UNITED STATES PATENT AND TRADEMARK OFFICE

CERTIFICATE OF CORRECTION

PATENT NO. : 6,866,364 B2
DATED : March 15, 2005
INVENTOR(S) : Torgerson et al.

It is certified that error appears in the above-identified patent and that said Letters Patent is hereby corrected as shown below:

Title page,
Item [75], Inventors, after "Mark H. MacKenzie, Corvallis, OR (US)", add
-- Simon Dodd, Corvallis, OR (US) --

Signed and Sealed this

Twenty-fourth Day of May, 2005

JON W. DUDAS
*Director of the United States Patent and Trademark Office*